US007082864B1

(12) United States Patent
Weber

(10) Patent No.: US 7,082,864 B1
(45) Date of Patent: Aug. 1, 2006

(54) TOOL WITH PROTECTIVE SHEATH

(75) Inventor: Joseph C Weber, Rockford, IL (US)

(73) Assignee: International Paper Company, Stamford, CT (US)

( * ) Notice: Subject to any disclaimer, the term of this patent is extended or adjusted under 35 U.S.C. 154(b) by 0 days.

(21) Appl. No.: 11/111,425

(22) Filed: Apr. 21, 2005

(51) Int. Cl.
*B25B 13/06* (2006.01)

(52) U.S. Cl. ..... 81/184; 81/180.1; 81/488; 81/492

(58) Field of Classification Search ..... 81/180.1, 81/184, 492, 488, 900
See application file for complete search history.

(56) References Cited

U.S. PATENT DOCUMENTS

| | | | | |
|---|---|---|---|---|
| 1,686,681 | A | 10/1928 | Canode | |
| 3,433,108 | A | 3/1969 | Ondeck | |
| 3,779,105 | A | 12/1973 | Triplett et al. | |
| 4,004,476 | A | 1/1977 | DeVrou | |
| 4,530,261 | A | 7/1985 | Ventura | |
| 4,800,786 | A | 1/1989 | Arnold et al. | |
| 4,825,732 | A * | 5/1989 | Arnold | 81/121.1 |
| 4,836,067 | A | 6/1989 | Rogers et al. | |
| 4,947,713 | A | 8/1990 | Arnold | |
| 4,979,355 | A | 12/1990 | Ulevich | |
| 5,003,849 | A * | 4/1991 | Lawrie | 81/184 |
| 5,009,133 | A | 4/1991 | Carey | |
| 5,309,799 | A * | 5/1994 | Jore | 81/451 |
| 5,617,766 | A | 4/1997 | Tsuji et al. | |
| 5,823,077 | A | 10/1998 | Macor | |
| 5,970,826 | A * | 10/1999 | Iwinski et al. | 81/124.6 |
| 6,029,547 | A | 2/2000 | Eggert et al. | |
| 6,138,538 | A | 10/2000 | Neijndorff | |
| 6,161,456 | A | 12/2000 | Langford | |
| D441,264 | S | 5/2001 | Bruns et al. | |
| 6,311,583 | B1 | 11/2001 | Izumisawa | |
| 6,338,357 | B1 | 1/2002 | Zevgolis | |
| 6,397,706 | B1 | 6/2002 | Maznicki | |
| 6,644,150 | B1 * | 11/2003 | Chen | 81/438 |
| 6,813,975 | B1 | 11/2004 | Kozak | |
| 6,962,098 | B1 * | 11/2005 | Eggert et al. | 81/124.6 |
| 2003/0192409 | A1 * | 10/2003 | Wallace | 81/121.1 |
| 2004/0144214 | A1 | 7/2004 | Ying-Hao | |
| 2005/0022631 | A1 | 2/2005 | Brazil | |

* cited by examiner

*Primary Examiner*—Lee D. Wilson
*Assistant Examiner*—Anthony Ojini
(74) *Attorney, Agent, or Firm*—Daniel C. Stelter

(57) ABSTRACT

A protective sheath for tools to prevent marring of finished surfaces when the tool is being used. The sheath is integrally formed as a one-piece elastomeric body that is applied to the exterior surface of the tool, with at least one end of the sheath projecting slightly beyond an end of the tool. In one embodiment the sheath projects at both ends beyond the ends of the tool. One of the projecting ends functions to contact the finished surface and prevent contact between the tool and finished surface, and the other projecting end functions to span the coupling between the tool and another tool. The elastomeric body is freely rotatable relative to the tool and fixed axially relative thereto, and provides a non-rotating surface that may be grasped by a user to support and guide the tool. Annular ribs on the inner surface of the sheath and/or a lubricant incorporated in the material of the sheath provide a reduction in friction, enabling the sheath to rotate freely on the tool even when it is grasped tightly by a person to support and guide the tool.

21 Claims, 5 Drawing Sheets

TOOL WITH PROTECTIVE SHEATH

TECHNICAL FIELD

This invention relates to tools having a protective sheath or cover to prevent damage to finished surfaces and minimize the risk of injury to workers.

BACKGROUND OF THE INVENTION

During the final assembly stages of many consumer products, including but not limited to appliances, automobiles, and the like, trim or finish pieces are commonly applied to the finished surfaces by inserting threaded fasteners through the trim or finish piece and into the finished surface. A worker typically applies these fasteners using various tools including screwdrivers, nut drivers, socket wrenches, and the like, or pneumatic or electric powered tools that drive various bits and/or sockets. These tools have hard metal surfaces, and in the case of screwdrivers or bits driven by power tools, for example, have relatively sharp or pointed edges that can easily mar the finished surface if they should slip off the fastener while it is being driven into place. Sockets, nut drivers and the like can also mar the surface if they contact it, especially while they are rotating during the installation or removal of a fastener. Accordingly, great care must be taken to ensure that the tool does not accidentally contact the finished surface and cause damage to it. This can occur, for instance, if the tool should slip off the fastener while it is being installed or removed, or if the rotating tool contacts the surface. The level of care required to avoid contact between the tool and finished surface can impair productivity, or inevitably lead to damage, especially in an industrial environment where a large number of fasteners may need to be installed in a relatively short period of time.

Moreover, workers using power fastener tools typically hold or loosely grip the rotating portion of the tool to support and guide it while they are installing or removing a fastener. When extensions are used between the power tool and the bit or socket or other fastener-engaging portion of the tool, the worker normally loosely places his or her hand around the extension to guide the tool. In torque sensitive applications, gripping of the rotating portion of the tool by the worker can result in incorrect torque application to the fastener. Further, because of this contact between the worker and the rotating portion of the tool, and the potential risk of the worker's hair becoming caught in the joint between attached components of the tool, such as, for example, between an extension and a socket, or between other joined together parts of the tool, injuries are not uncommon.

Conventional tools generally do not have any means to prevent contact between the hard metal surface of the tool and the finished surface, or between the worker and the rotating portions of the tool, although some efforts have been made in the prior art to solve the problem of marring finished surfaces. These efforts generally involve the provision of various cushioning devices or protective sleeves in association with the fastener-engaging portion of the tool. Examples of such prior efforts are disclosed in U.S. Pat. No. 5,009,133 to Carey (the '133 patent), and U.S. Pat. No. 6,138,538 to Neijndorff (the '538 patent), and in the nylon-coated, mar-resistant tools offered by Cooper Tools of Lexington, S.C., in its Apex® brand of fastener tools (the Apex® tool).

The '133 patent discloses several embodiments of protective sleeves that may be applied to the fastener-engaging portion of a tool, i.e., a socket, nut driver, screwdriver, or the like, to prevent contact between the hard metal of the tool itself and the finished surface, and these sleeves are designed so that there can be relative rotation between the tool and the sleeve. More specifically, the sleeve is described as having a relatively smooth inner surface that enables the sleeve to rotate on the tool, and a cushioning material on the end of the sleeve is designed to contact the finished surface and not move, i.e., not rotate, relative to the surface while the tool is rotating. In some embodiments, a ball bearing or other low friction cap is placed on the very end of the tool to function as the cushioning means, and in other embodiments a sleeve extends throughout the length of the socket or similar fastener-engaging portion of the tool and has an in-turned lip on its end that extends inwardly over the end of the tool to function as the cushioning means, or an o-ring or similar cushioning device is provided on the end of the sleeve to contact the finished surface. The '133 patent also suggests that the embodiment shown in FIGS. 11 and 12 can be held by a worker to support the tool while it is turning.

The nylon sheath in the Apex® tool is a coating applied to the socket or other fastener-engaging portion of the tool, and thus is fixed to the tool and turns with it. Similarly, the collar in the '538 patent is applied to an extension or to the socket or other fastener-engaging portion of the tool, and is fixed relative to the tool and turns with it.

The sleeves in the '133 patent are described as being made of a vinyl plastic or other similar resilient flexible material, such as rubber, and are disclosed as separately made and then applied to a tool. The collar in the '538 patent is disclosed as being either manufactured separately and then applied to a tool, or molded on the tool, and is further described as being made of a polymeric material having at least some elasticity, for example, an ABS elastomer, SAN elastomer, a polyurethane elastomer, or the like. Polymers such as polyethylene, polypropylene, and nylon are also disclosed in the '538 patent as useful. Other materials such as polycarbonate, polyacrylate, polyaramide, polyethersulfone, polysulfone, poletherketone, polyetherimide, polyimide, and the like are also disclosed as useful.

The collar in the '538 patent is applied only to the fastener-engaging portion of the tool, i.e., the socket or bit, and is intended solely to prevent marring of the finished surface. There is no suggestion of applying it to any extension, or covering any joints between connected parts, or making the tool rotatable in the collar so that the collar provides a non-rotating surface that can be gripped by the hand of the worker to guide and support the tool without having to contact a rotating part.

Similarly, and although the coating applied to the Apex® tool is shown as applied to both the fastener-engaging portion of the tool, i.e., the socket or bit, and also to an extension, the coating is fixed relative to the tool and thus does not provide a non-rotating surface that can be grasped by the user to support and guide the tool without having to contact a rotating surface.

The sleeve in the '133 patent is also disclosed as applied only to the fastener-engaging portion of the tool, i.e., the socket or bit, and is intended solely to prevent marring of the finished surface. The sleeve in this patent is designed so that the tool rotates in it, thus providing an exterior surface that does not rotate and that can be gripped by a worker to support and guide the tool, but there is no suggestion of applying it to any extension, or covering any joints between connected parts. Neither is there any suggestion of providing means to enable the sleeve to be gripped without affecting the torque of the tool, that is, absorbing some of the energy output of the tool and potentially resulting in inadequate torque being applied to the fastener.

Further, none of the protective coverings known to applicant extend over flexible portions of the tool, such as over swivel connections or adapters, or over flex shafts and the like.

Accordingly, there is need for a non-rotating protective sheath for a tool, wherein the sheath is effective to prevent marring of finished surfaces and also provides a non-rotating surface that can be grasped by a worker to support and guide the tool without affecting the torque output of the tool, that covers connections or joints between connected parts of the tool, and that covers flexible portions of the tool, such as flex shafts, swivel connectors and adapters, and the like.

SUMMARY OF THE INVENTION

The invention comprises a protective sheath for tools, wherein the sheath is effective to prevent marring of finished surfaces and also provides a non-rotating surface that can be grasped by a worker to support and guide the tool without affecting the torque output of the tool, that covers connections or joints between connected parts of the tool, and that covers flexible portions of the tool, such as flex shafts, swivel connectors and adapters, and the like.

The sheath of the invention can be molded directly onto the tool, or molded as a separate part and then applied to a tool. It can be applied to sockets, nut drivers, flexible connectors, extensions, universal joints, countersink tools, and the like, of various sizes and designs for installing and removing any of the commonly used fasteners, or other fasteners and devices.

In a preferred embodiment, the sheath extends throughout the length of the tool and projects slightly beyond both ends of the tool. However, the sheath can have a length such that it does not project beyond the ends of the tool, or it can project beyond one or both ends up to a distance that does not interfere with use of the tool. In those embodiments where an end of the sheath projects beyond that end of the tool that engages the fastener, the projecting end will contact a finished surface and prevent contact between the tool and the surface, thereby preventing marring of the surface. The end of the sheath projecting beyond the opposite end of the tool will cover the connection or joint between the tool and another tool part, such as an extension, and minimize or prevent the risk of hair, clothing, jewelry, and the like, becoming entangled in the connection as the tool rotates.

As applied to an extension, the sheath projects beyond the female end of the extension, but leaves the tang exposed at the other end. When another tool part, such as a socket or another extension or the like is connected to the female end of the extension, the projecting end of the sheath covers the joint between the connected parts. In this regard, if two extensions are connected together in end-to-end relationship, the tang on first extension is received in the female end of a second extension and the end of the sheath at the tang end of the first extension telescopes into the projecting end of the sheath at the female end of the second extension, whereby the connection between the two extensions is completely covered. Similarly, if a sheathed socket or other tool is connected to a sheathed extension, the adjoining ends of the sheaths on the two tool parts telescope slightly into one another, completely covering the joint between the two tool parts.

The sheath of the invention, whether applied to a socket or an extension or other tool part, is freely rotatable on the tool and is constructed so that it can be grasped to provide a safe and comfortable means of holding and guiding the tool, and not affect the torque applied to a fastener with the tool, regardless of how tight the sheath is gripped. This is accomplished, at least in part, by making the sheath of a material having a low coefficient of friction. For instance, the effect on fastener torque when using the sheath of the invention is negligible in comparison with the effect of a gloved hand, i.e., the work required to overcome the friction of the sheath is only from about 0.1 Newton meter (Nm) to about 0.2 Nm, compared to about 0.3 to 0.6 Nm with a gloved hand. Further, the torque impact of the sheath on the tool part is substantially less than the impact of a gloved hand, i.e., 0.138 Nm versus 0.589 Nm when used on an extension, and 0.138 Nm versus 0.351 when used on a socket. The friction of the sheath on the tool part also is very consistent. No silicone is used in the manufacture of the sheath since this material can have a deleterious effect on the finished surface, for example.

In a preferred embodiment, the material comprises a composition of from about 60% to about 80% thermoplastic polyurethane, from about 1% to about 5% lubricant, from about 1% to about 4% epoxy additive, and from about 5% to about 20% thermoplastic polyester resin, with a hardness or durometer preferably in the range of from about 10 to about 90 on the d Shore scale. This formulation provides a sheath that is tough and stable, and that will allow the tool to rotate freely in the sheath under a variety of conditions.

The Apex® socket, as seen best in FIG. 8, has an annular channel or groove formed in the outer surface near the end opposite that which engages the fastener, and a pair of aligned holes lying on a diameter of the socket are formed through the socket at the location of the groove. In Europe, in particular, this socket is used by inserting the tang of a drive tool, extension, or the like, into the proximal end of the socket and then inserting a pin through the holes in the socket and through a corresponding aligned hole in the tang, and then applying a band, such as an o-ring or the like, in the groove to hold the pin in place and thus hold the socket to the other tool part. The sheath of the invention, when applied to an Apex® socket, utilizes this groove to hold the sheath in axial position on the socket by providing an internal annular rib in the sheath that engages in the groove. This rib not only functions to hold the sheath in axial position on the tool, but can also function in lieu of a separate o-ring to hold the pin in place in those instances when a pin is used to hold the socket to the other tool part. Lubricant or plasticizer incorporated in the material of the sheath may be concentrated in the area of the rib, or may be distributed throughout the material of the sheath.

When used on tools having smooth exterior surfaces, an inwardly directed annular rib is provided in each end of the sheath in appropriately spaced relationship to engage against the opposite ends of the tool to hold the sheath in place against axial movement on the tool. Lubricant can be concentrated in the area of the ribs, or distributed throughout the sheath material.

When applied to extensions or other long tool parts, a plurality of inwardly projecting annular ribs may be provided on the interior surface of the sheath between its ends to provide spaced areas of contact between the sheath and the tool. These ribs preferably are spaced approximately 3 inches apart.

In one embodiment of the invention, the sheath is adapted for use with tools that are designed to countersink fasteners, and has a wall section that deforms when the distal or forward end of the sheath engages a surface as the fastener is driven into the surface, thereby effectively retracting the forward end of the sheath so that the fastener can be countersunk with the tool without interference from the sheath.

In another embodiment, the sheath has a swivel or universal connection, enabling it to be used with universal joints or other swivel adapters and connections.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE PREFERRED EMBODIMENTS

Figure 1:
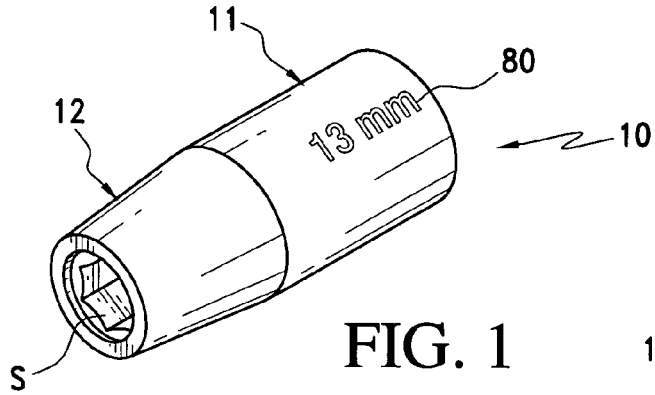
FIG. 1 is a perspective view of a socket tool having the sheath of the invention thereon, looking toward the end of the socket that engages the fastener.
Figure 2:
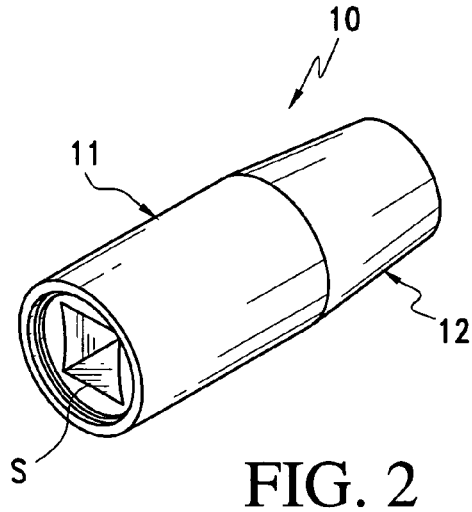
FIG. 2 is a perspective view of the socket tool and sheath of FIG. 1, looking toward the opposite end of the socket.

A first form of protective sheath according to the invention is indicated generally at 10 in FIGS. 1, 2, 6, 7 and 8, and as shown in these figures is applied to a socket S of the type sold by Cooper Tools under the name Apex®. In this embodiment, the socket has a cylindrical rearward or proximal end 11 and a slightly inwardly tapered forward or distal end 12, and the sheath 10 closely conforms to this shape. The wall of the sheath has a suitable thickness, e.g., about 5.334 mm throughout the length of the cylindrical section 11, and tapering from that thickness at the juncture of the cylindrical section 11 and tapered section 12 to about 3.33 mm at the distal or terminal end of the tapered section. The sheath has smooth inner and outer surfaces 13 and 14, respectively, and in the embodiment shown in these figures an inwardly projecting annular rib 15 is formed on its inner surface in position to extend into an annular channel or groove 16 formed in the outer surface of the socket near the proximal end 11 to hold the sheath in proper axial position on the socket, with opposite ends 17 and 18 of the sheath extending slightly beyond the ends of the socket, as indicated at 19 and 20. The extent to which the sheath extends beyond the ends of the tool, in those versions where it does extend, varies in dependence upon the particular application, but the sheath should not interfere with use of the tool.

As noted previously, the Apex® socket has a pair of aligned holes 21 lying on a diameter of the socket and formed through the socket at the location of the groove 16. In Europe, in particular, this socket is used by inserting the tang of a drive tool, extension, or the like, into the proximal end of the socket and then inserting a pin (not shown) through the holes in the socket and through a corresponding aligned hole in the tang, and then applying a band, such as an o-ring or the like (not shown), in the groove to hold the pin in place and thus hold the socket to the other tool part. The sheath of the invention, when applied to an Apex® socket, utilizes this groove to hold the sheath in axial position on the socket by positioning the annular rib 15 in the sheath so that it engages in the groove. The rib thus not only functions to hold the sheath in axial position on the tool, but it can also function in lieu of a separate o-ring to hold the pin in place in those instances when a pin is used to hold the socket to another tool part.

Figure 3:
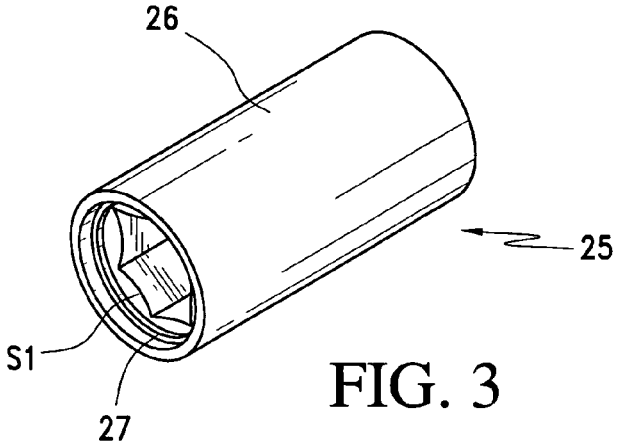
FIG. 3 is a perspective view of an alternate form of socket tool with a sheath according to the invention thereon.
Figure 10:
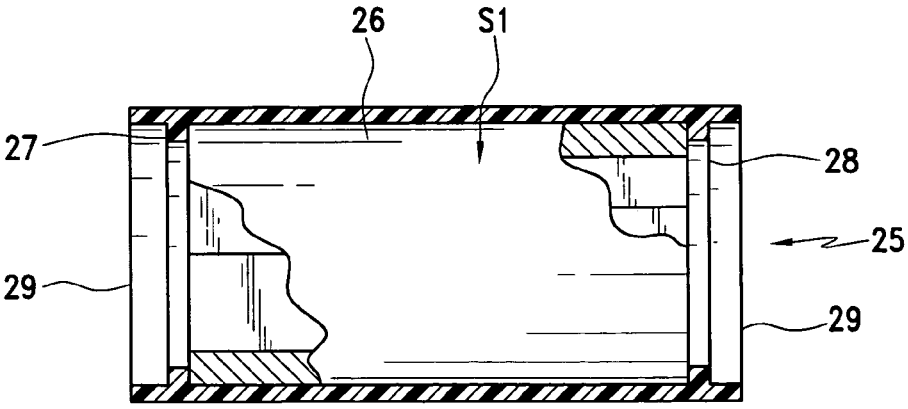
FIG. 10 is a side elevational view of the socket and sheath of FIG. 3, with the sheath shown in longitudinal section and portions of the socket shown in section, depicting an embodiment wherein the sheath is held on the tool by in-turned lips at opposite ends of the sheath.

A second embodiment of the sheath of the invention is indicated generally at 25 in FIGS. 3 and 10. In this embodiment, the sheath is applied to a socket S1 having a smooth, constant diameter outer surface 26, and the sheath likewise has a constant diameter and closely conforms to the socket. The sheath has inwardly directed annular ribs 27 and 28 in its opposite ends and these ribs engage against the ends of the socket to hold the sheath against axial shifting on the socket. The ends of the sheath project beyond the location of the ribs, as indicated at 29, whereby when two tool parts are coupled together in end-to-end relationship, the projecting ends of the sheath overlap or telescope to cover the connection. The wall of this sheath has a constant thickness throughout its length of, e.g., about 5 mm.

Figure 11:
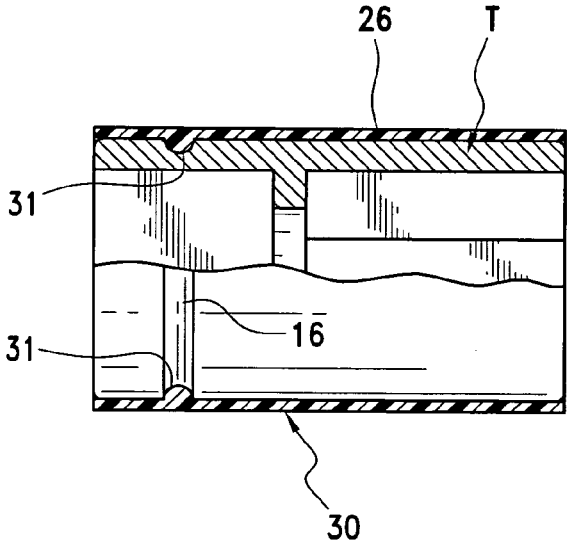
FIG. 11 is a longitudinal sectional view of a variation of the sheath shown in FIG. 10, wherein the sheath does not extend past the ends of the tool, and wherein a single annular rib engages in an annular groove in the tool, rather than the spaced annular ribs at opposite ends of the sheath engaged against opposite ends of the tool to hold the sheath in axial position on the tool, as shown in FIG. 10.
Figure 12:
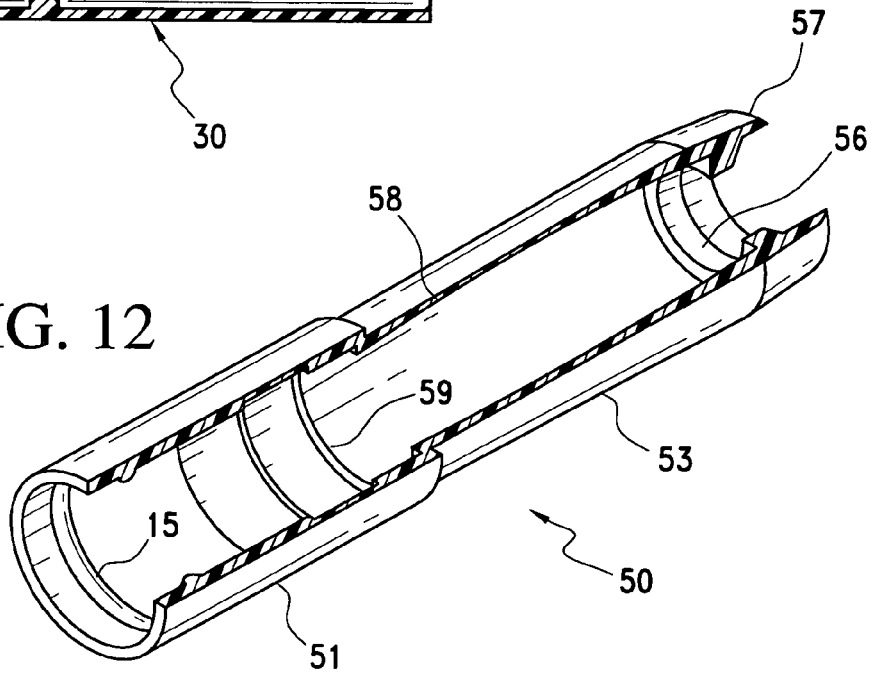
FIG. 12 is a perspective view, with portions broken away and portions shown in section, of a sheath according to the invention, with an axially collapsible section to enable its use with a tool for countersinking fasteners.
Figure 13:
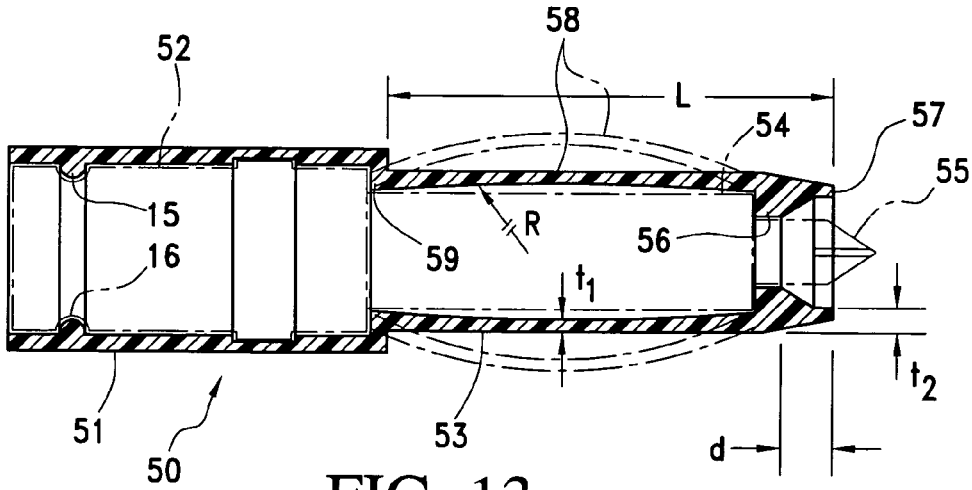
FIG. 13 is an enlarged longitudinal sectional view of the sheath of FIG. 12.
Figure 14:
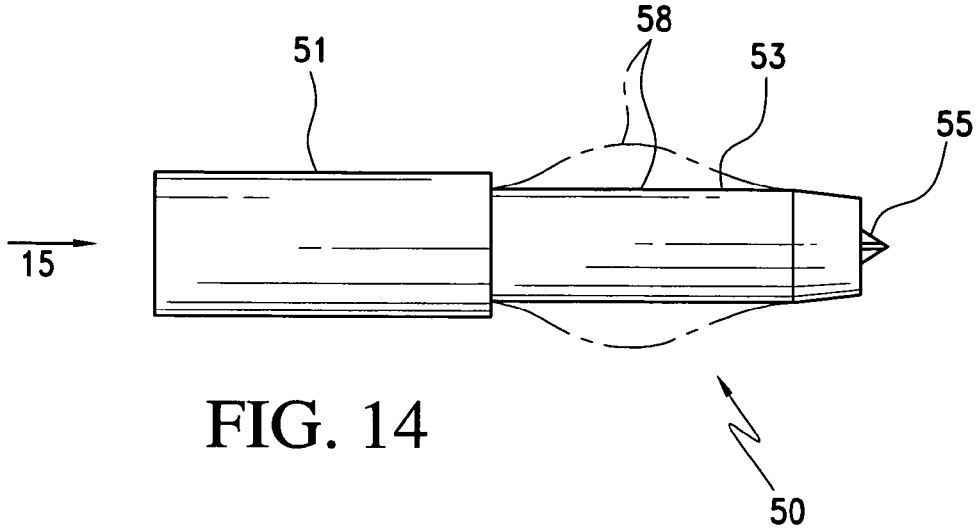
FIG. 14 is a side view in elevation of the sheath of FIG. 12.

A variation of the sheath of FIG. 10 is shown at 30 in FIG. 11. This sheath has an annular rib 31 on its inner surface for engagement in an annular channel on the outer surface of a tool part T. In this embodiment, the sheath is coextensive in length with the length of the tool and does not project beyond the ends.

Figure 4:
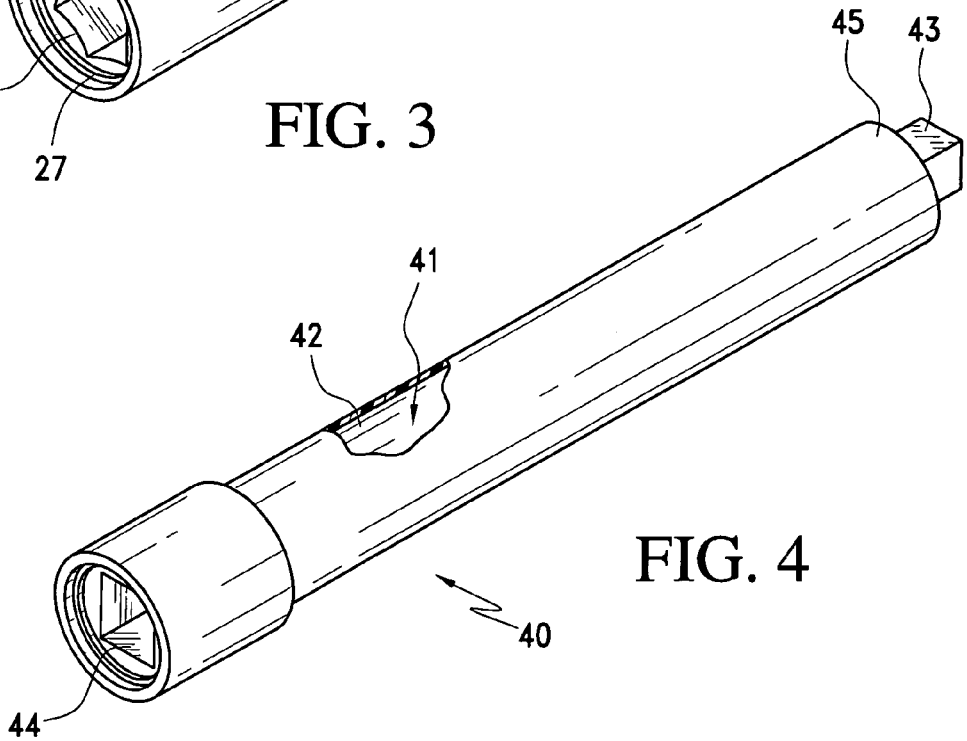
FIG. 4 is a perspective view of an extension tool having the sheath of the invention thereon, looking toward the female end of the extension.
Figure 5:
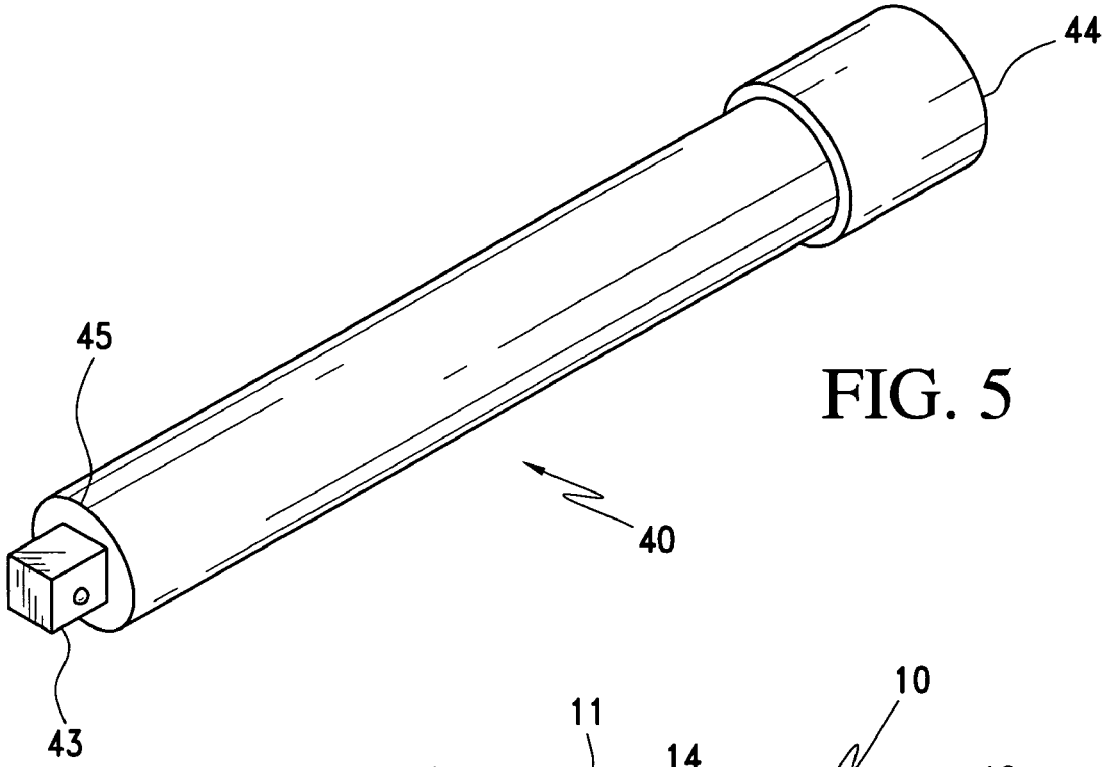
FIG. 5 is a perspective view of the extension tool of FIG. 4, looking toward the opposite or male end of the extension.
Figure 6:
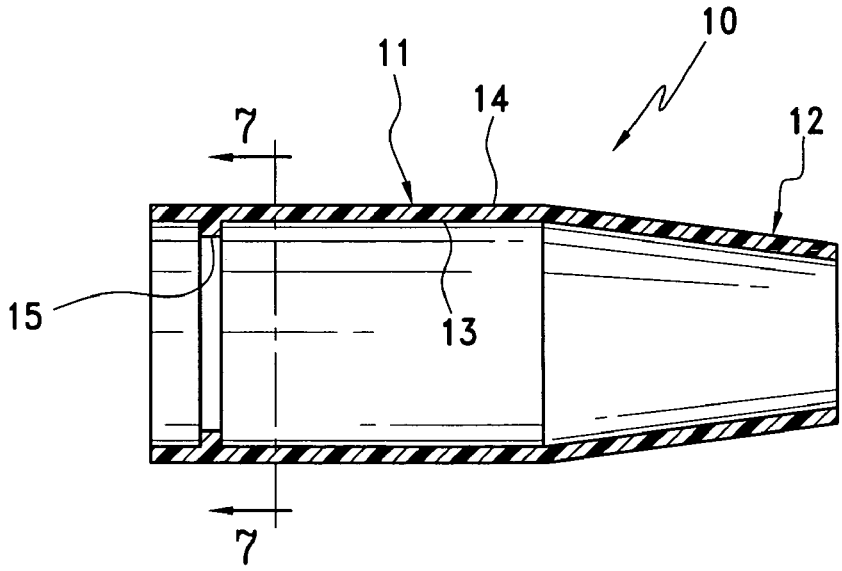
FIG. 6 is a longitudinal sectional view of that embodiment of sheath according to the invention that is adapted to be placed on an Apex® socket, as depicted in FIGS. 1 and 2, for example.
Figure 7:
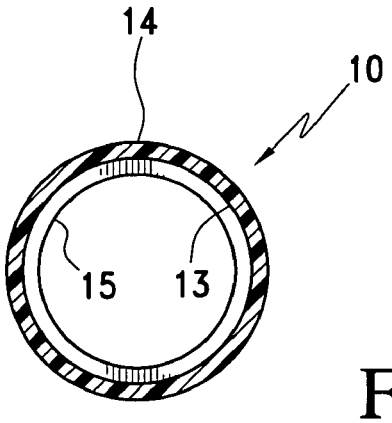
FIG. 7 is a transverse sectional view of the sheath of FIG. 6, taken along line 7—7 in FIG. 6.
Figure 8:
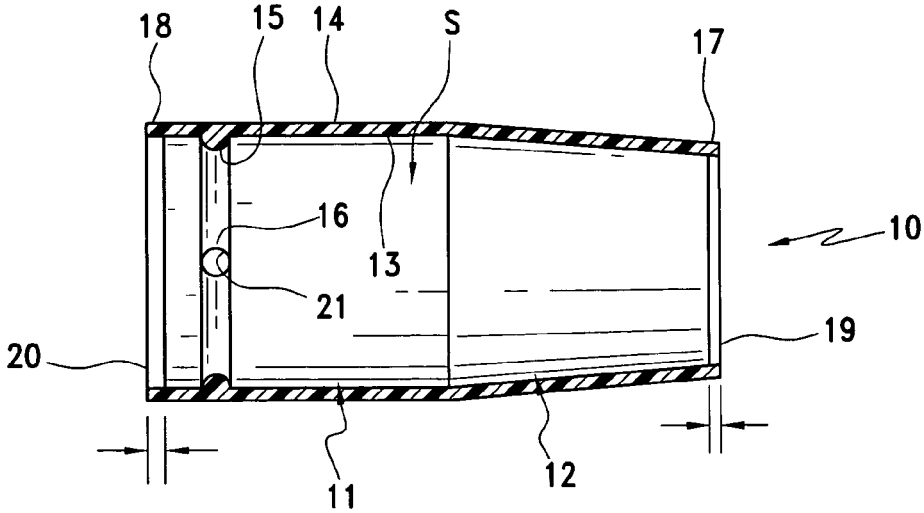
FIG. 8 is a side elevational view of the socket and sheath of FIGS. 1 and 2, with the sheath shown in longitudinal section, depicting an embodiment wherein the sheath is held against axial movement on the socket by an annular rib on the sheath engaged in an annular channel in the socket.
Figure 9:
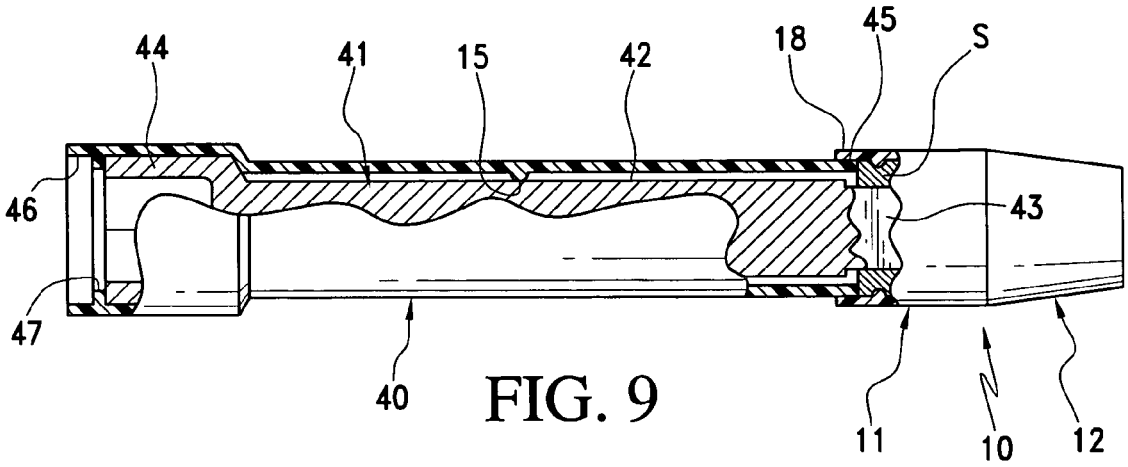
FIG. 9 is a view in side elevation, with portions broken away, showing a sheathed socket and extension connected together, and depicting how the sheaths overlap or telescope to completely cover the joint or connection between the two tool parts.

A further embodiment of the sheath of the invention is indicated at 40 in FIGS. 4, 5 and 9. In this form of the invention, the sheath is shown applied to an extension 41 for connection between a ratchet wrench (not shown) or power tool (not shown) or other suitable device for operating the tool, and a socket or other tool, such as a fastener driver, e.g., socket S as shown in FIG. 9. The extension has an elongate body 42 with a male end 43 and a female end 44. Extensions come in various lengths, and can be connected together in end-to-end relationship, or connected between a socket or other tool and a device such as a ratchet wrench or power tool. If the extension, or other tool, has a length of no more than about 3 inches, then the interior surface of the sheath 40 can be smooth, as shown in the embodiment of FIG. 10. However, if the length of the extension or other tool has a length greater than about 3 inches, then it is preferred to provide one or more annular ribs 15 on the inner surface of the sheath, spaced about 3 inches apart, as shown, e.g., in FIG. 9, to minimize friction between the sheath and the tool.

As seen in FIG. 9, when the extension 41 is coupled with a socket S or other tool, the end 45 of the sheath on the male end of the extension telescopes into the projecting end 18 of the sheath on the socket proximal end, thereby completely covering the joint or connection between these tool parts. The opposite end 46 of the sheath projects beyond the female end of the extension, and an inwardly directed annular rib 47 engages against the end of the extension to hold the sheath in axial position on the extension.

A further embodiment is shown at 50 in FIGS. 12–15, wherein the sheath is adapted for a tool used to countersink fasteners. In the particular example shown, the sheath has a generally cylindrically shaped proximal or rearward end 51 received over a tool part 52, and held thereon against axial displacement by annular rib 15 on the inner surface of the sheath engaged in annular groove 16 in the tool. The sheath has a reduced diameter, generally cylindrical intermediate portion 53 that encircles a tool part 54, e.g., a magnetic bit holder or other tool, carrying a fastener-engaging driver, such as, e.g., bit 55, at its forward end. A radially inwardly projecting annular collar 56 is formed in the distal end 53 of the sheath, spaced a short distance axially inwardly of its forward most end, for supporting the sheath on a forward end portion of the tool part 54. The forward or distal end 57 of the sheath projects a short distance d beyond the collar and defines a skirt that surrounds the fastener bit 55 and contacts the work surface to prevent marring by the tool. The intermediate portion 53 of the sheath has a thin wall section 58 between its ends that buckles or deforms when the forward end of the sheath engages the work surface during countersinking of a fastener, to permit the end of the sheath to retract and permit countersinking of the fastener.

In a specific example of a protective sheath 50 for use on a tool to countersink fasteners, the forward section 53 can have any length L suitable for the intended application, and can range, for example, from about 2 inches to about 4 inches or more. The wall thickness $t_1$ at the thin wall section is about 0.033 inches, whereas the wall thickness $t_2$ adjacent the collar 56 is about 0.090 inches. The thin wall section in the specific example shown is achieved by giving a curved concave shape to the inner surface of the intermediate section. Again, in the particular example shown, the radius of curvature R of this curvature is about 9.17 inches. Because of the thin-walled section, when the tool is used to countersink a fastener, the forward end of the sheath can retract a distance sufficient to enable the fastener to be countersunk without interference from the sheath.

The collar 56 and annular surface 59 at the rearward end of intermediate section 53 define bearing and lubrication points for the sheath on the tool. Bearing surface 59, in particular, provides support to facilitate outward flexing of the wall of section 53.

Figure 15:
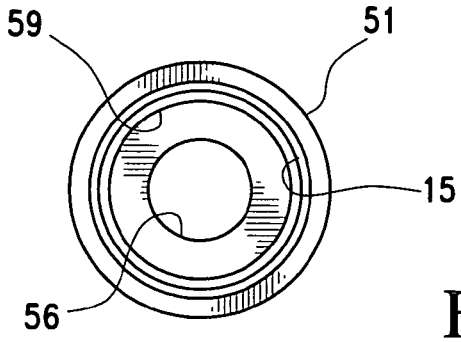
FIG. 15 is an end view of the sheath of FIG. 12, taken in the direction of the arrow 15 in FIG. 14.
Figure 16:
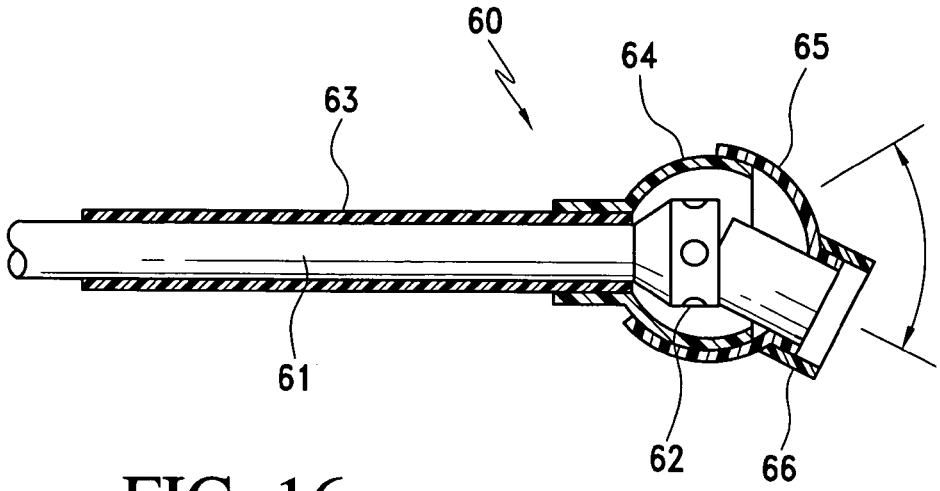
FIG. 16 is a longitudinal sectional view of an embodiment in which the sheath has a portion that provides a universal swivel connection for use with tools having a swivel connection, with the tool and sheath shown in a position swiveled to one side.

Another embodiment of the invention is shown at 60 in FIGS. 15 and 16. In this embodiment, the sheath 60 is adapted for use on an extension 61 with a universal joint 62, or other swivel or flexible tool, and comprises a first sleeve 63 surrounding the extension, with a first part-spherical, forwardly open member 64 attached to the forward end of the first sleeve and partially surrounding the universal joint. A second part-spherical, rearwardly open member 65 mates with the first part-spherical member and is connected with a second sleeve defining a forwardly projecting annular tip 66 that extends past the forward end of the tool part projecting from the universal joint. In the particular embodiment shown, the universal or flexible sheath design is comprised of four parts: the first sleeve 63, preferably made of urethane; the first and second mated part-spherical members 64 and 65, preferably made of a relatively harder plastic such as ABS or vinyl; and the second sleeve or forwardly extending tip 66, preferably made of urethane.

Suitable markings 80 (FIG. 1) and/or color-coding can be applied to the sheath to indicate the size and/or type of socket or other fastener tool covered by the sheath.

A fastener tool incorporating a sheath according to the invention is safer and easier to use than conventional fastener tools, and can be held and supported by the hand of a user without the risk of injury that exists with conventional rotating power tools, and without absorbing any of the torque output of the power source, regardless of how tightly the tool is gripped by the user. The portions of the sheath that extend past the end of the tool that engages the fastener prevent marring of finished surfaces. The sheath is sufficiently thin that it does not impede use of the sheathed tool in confined spaces.

While particular embodiments of the invention have been illustrated and described in detail herein, it should be understood that various changes and modifications may be made in the invention without departing from the spirit and intent of the invention as defined by the appended claims.

What is claimed is:

1. A protective sheath for fastener tools to prevent marring of finished surfaces and provide a non-rotating surface that can be grasped for supporting and guiding the tool when the tool is being used to install or remove fasteners in the surface, wherein said sheath comprises:

a one-piece, integrally molded elastomeric body applied to the exterior surface of a tool throughout the length of the tool and having at least one end projecting slightly beyond an end of the tool, wherein:

said elastomeric body is freely rotatable relative to the tool and fixed axially relative thereto, and provides a non-rotating surface that may be grasped by a user to support and guide the tool; and said elastomeric body has friction-reducing means enabling the tool to rotate freely within the elastomeric body even when the body is grasped tightly by a person to support and guide the tool.

2. A protective sheath as claimed in claim 1, wherein:

said sheath is fixed axially relative to the tool by an integrally formed, inwardly projecting rib in the sheath engaged in an annular groove or channel in the exterior surface of the tool.

3. A protective sheath as claimed in claim 1, wherein:
said sheath is fixed axially relative to the tool by integrally formed, in-turned lips on opposite ends of the sheath engaged over opposite ends of the tool.

4. A protective sheath as claimed in claim 1, wherein:
one or more inwardly directed annular ribs are formed on an inner surface of said sheath for contacting the exterior surface of the tool to minimize friction between the tool and sheath.

5. A protective sheath as claimed in claim 1, wherein:
the friction reducing means comprises a lubricant incorporated in the material of the sheath.

6. A protective sheath as claimed in claim 5, wherein:
said sheath is fixed axially relative to the tool by an integrally formed, inwardly projecting rib in the sheath engaged in an annular groove or channel in the exterior surface of the tool; and
the lubricant is concentrated in the area of the rib.

7. A protective sheath as claimed in claim 5, wherein:
one or more inwardly directed annular ribs are formed on an inner surface of said sheath for contacting the exterior surface of the tool to minimize friction between the tool and sheath; and
the lubricant is concentrated in the area of the rib.

8. A protective sheath for flexible or articulated fastener tools to prevent marring of finished surfaces and provide a non-rotating surface that can be grasped for supporting and guiding the tool when the tool is being used to install or remove fasteners in the surface, wherein said sheath comprises:
a material having sufficient softness that it will not mar a finished surface if it contacts it, and sufficient durability to withstand rough handling, wherein:
said sheath extends along the length of the articulated fastener tool and is freely rotatable relative to the tool and fixed axially relative thereto, providing a non-rotating surface that may be grasped by a user to support and guide the tool; and
said sheath has friction-reducing means enabling the tool to rotate freely within the sheath even when the sheath is grasped tightly by a person to support and guide the tool.

9. A protective sheath as claimed in claim 8, wherein:
said articulated fastener tool comprises first and second tool parts with a universal joint between them; and
said sheath includes a portion around and movable with said universal joint.

10. A protective sheath as claimed in claim 9, wherein:
said portion movable with said universal joint comprises a ball and socket connection between a first sheath part on said first tool part, and a second sheath part on said second tool part.

11. A protective sheath as claimed in claim 10, wherein:
said first sheath part comprises a first sleeve extending over said first tool part;
said second sheath part comprises a second sleeve extending over said second tool part; and
said ball and socket connection comprises a first part-spherical member on an end of said first sleeve adjacent said universal joint, and a second part-spherical member on an adjacent end of said second sleeve, one of said part-spherical members being rotatably engaged over the other.

12. A protective sheath as claimed in claim 11, wherein:
said second sleeve includes a non-marring tip adapted to contact a surface to prevent marring of the surface.

13. A protective sheath for tools to prevent marring of finished surfaces and provide a non-rotating surface that can be grasped for supporting and guiding the tool when the tool is being used, wherein said sheath comprises:
a one-piece, integrally molded, soft elastomeric body for application to the exterior surface of a tool and adapted to extend along the length of the tool, said sheath having integrally formed means for cooperating with the tool to prevent relative axial movement between the tool and sheath and to enable free relative rotation between the tool and sheath.

14. A protective sheath as claimed in claim 13, wherein:
said elastomeric body comprises a composition of a thermoplastic polyurethane and a lubricant.

15. A protective sheath as claimed in claim 14, wherein:
said polyurethane is present in the composition in a range of from about 60% to 80% of the composition; and
said lubricant is present in the composition is a range of from about 1% to about 4% of the composition.

16. A protective sheath as claimed in claim 15, wherein:
said composition includes an epoxy additive and a thermoplastic polyester resin.

17. A protective sheath as claimed in claim 16, wherein:
said epoxy additive is present in the composition in a range of from about 1% to 4% of the composition, and the polyester resin is present in a range of from about 5% to 20% of the composition.

18. A protective sheath as claimed in claim 17, wherein:
said elastomeric body has a hardness in the range of from about 10 to about 90 on the d Shore scale.

19. A socket having a cover over its length to prevent marring of finished surfaces and provide a non-rotating surface that can be grasped for supporting and guiding the tool when the tool is being used, wherein:
said socket has a first end adapted to be connected with another tool, a second end adapted to engage a fastener or other device to rotate the fastener or other device, and an annular channel or groove in an exterior surface of said first end; and
said cover comprises an elastomeric sheath that conforms closely to the shape of the socket and has an integral, inwardly directed annular rib on its inner surface engaged in said groove to retain the sheath on the socket, wherein said sheath is rotatable relative to said socket.

20. A socket as claimed in claim 19, wherein:
said first end of said socket is cylindrically shaped, and said second end is tapered.

21. A socket as claimed in claim 19, wherein:
opposite ends of said sheath project beyond opposite ends of said socket so that when said socket is coupled to another tool part, at least one of the projecting ends of the sheath spans the coupling between the socket and the other tool part.

* * * * *